United States Patent [19]

Work

[11] 4,168,117

[45] Sep. 18, 1979

[54] PHOTOGRAPHIC PROCESSING TANK

[76] Inventor: Gerald L. Work, E. 1701 20th, Spokane, Wash. 99203

[21] Appl. No.: 3,036

[22] Filed: Jan. 12, 1979

[51] Int. Cl.[2] ..... G03D 13/04

[52] U.S. Cl. ..... 354/324; 354/331; 220/23.8; 220/427

[58] Field of Search ..... 354/299, 315, 323, 324, 354/326, 327, 331, 337, 297; 220/1 C, 23.8, 427, 428

[56] References Cited

U.S. PATENT DOCUMENTS

| | | | |
|---|---|---|---|
| Re. 27,449 | 8/1972 | Bartz | 220/1 C |
| 1,772,834 | 8/1930 | Hopkins | 354/299 |
| 2,232,998 | 2/1941 | Cernohouz et al. | 354/331 |
| 2,238,661 | 4/1941 | Shaeffer | 354/331 |
| 2,384,898 | 9/1945 | Dietert | 354/327 |
| 2,748,677 | 6/1956 | Berlant | 354/331 |
| 2,768,566 | 10/1956 | Powell | 354/297 |
| 2,925,767 | 2/1960 | Hixon et al. | 354/299 |
| 2,930,306 | 3/1960 | Goodman | 354/299 |
| 3,000,288 | 9/1961 | Winnek | 354/299 |
| 3,147,366 | 9/1964 | Dreyfoos | 354/324 |
| 3,294,004 | 12/1966 | Benson | 354/324 |
| 3,626,834 | 12/1971 | Speranza | 354/299 |
| 3,890,629 | 6/1975 | Huss | 354/299 |
| 4,138,689 | 2/1979 | Montalbano | 354/327 |

*Primary Examiner*—L. T. Hix

*Assistant Examiner*—Alan Mathews

*Attorney, Agent, or Firm*—Wells, St. John & Roberts

[57] ABSTRACT

A photographic developing tank is described to aid in processing light-sensitized photographic materials such as paper, plates, or film. The tank is formed as a unitary body structure having an enclosed water cavity extending between and defined by integral walls of the tank structure. A top wall of the structure includes two or more indentations to form integral photographic processing trays. The indentations extend downwardly into the water cavity to bottom walls that are spaced upwardly from the unitary base wall of the tank. Drain passageways extend from the indentations outward through the cavity to the exterior of the tank. Petcocks are provided at the outer ends of the passageways to allow individual drainage of the fluid contents from the respective trays. Inlet and discharge ports are provided that enable water to flow through the water cavity. The water while in the water cavity completely surrounds the peripheral walls of the indentations as well as the bottom walls thereof. The indentation walls are of uniform thickness so heat is transferred evenly through the walls to the processing chemicals held within the indentations. Consequently the chemicals in the various trays are held to the same temperature to improve the photographic developing process.

10 Claims, 3 Drawing Figures

PHOTOGRAPHIC PROCESSING TANK

BACKGROUND OF THE INVENTION

The present invention is related to photographic material processing tanks.

Expensive and complicated apparatus are utilized by commercial film processing businesses for rapidly and accurately processing photographic materials. This sophisticated and expensive equipment is not easily accessible to the amateur photographer or small professional studio. Still, it is very desirable to provide an optimum environment for processing films, papers, and plates that will have the effect of producing professional looking results. One of the requirements in processing papers is that the temperature of processing fluids be maintained within a certain range and more particularly that the temperature variation from one chemical to another be held at a bare minimum.

In the past, paper developing chemicals have been placed in metal or plastic trays. The trays, in turn, are placed in larger tanks full of warm water prior to the processing steps. The warm water, if the volume is sufficient, is at least partially effective in maintaining a low temperature differential between the several chemicals used. However, use of large volumes of water in an open tank in addition to the several processing liquid receiving trays, often leads to accidental spillage and frustration of the dark room attendant. Portable trays are not usually provided with individual drains and must be lifted and manually dumped, usually through a funnel arrangement back into their storage containers after each use. The trays are usually large, especially where processing of large prints is desired. They are therefore very difficult to handle when full of processing fluids. Spillage of the fluids, some of which are caustic, can result in damage to dark room fixtures as well as to the clothing and person of the attendant.

It therefore becomes desirable to obtain some form of unitary processing tank that includes capabilities for holding temperature differentials between adjacent trays at a bare minimum and which may be easily handled (filled and emptied) by a dark room attendant. It is also desirable to provide such a processing tank that is within the economic grasp of the average amateur photographer.

DETAILED DESCRIPTION OF A PREFERRED EMBODIMENT

Figure 2:
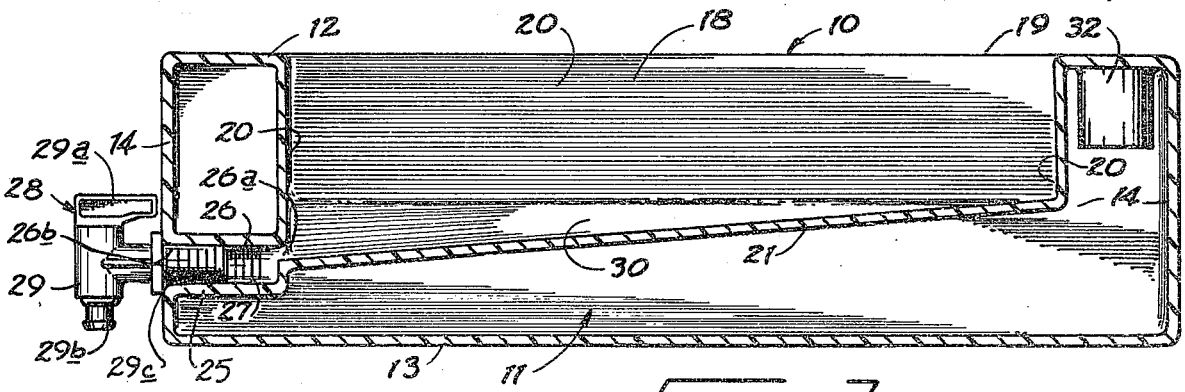
FIG. 2 is an enlarged cross-sectional view taken substantially along line 2—2 in FIG. 1.
Figure 3:
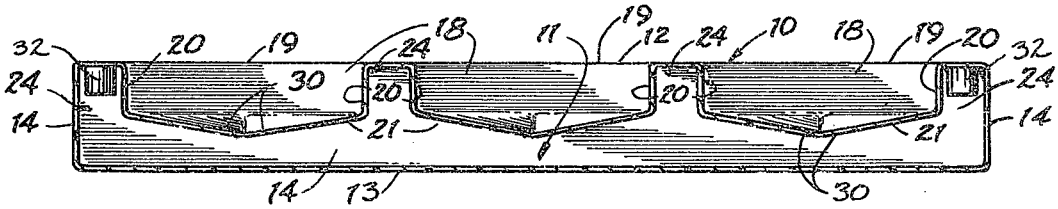
FIG. 3 is a cross-sectional view taken substantially along line 3—3 in FIG. 1.

The present processing tank for developing light sensitive photographic materials is generally indicated in the drawings by the reference character 10. The tank 10 includes a unitary body structure having a single enclosed water cavity 11 that is best seen in FIGS. 2 and 3. The water cavity 11 is defined by integral top wall 12, base wall 13 and side walls 14 of the unitary body structure. The walls 12, 13 and 14 are integral, being formed of a single material, preferably synthetic resin.

Several indentations that form photographic material receiving trays 18 are formed in the top wall 12 of the tank. Each tray 18 extends downwardly into the water cavity 11 from a top opening 19 to a bottom wall 21. Peripheral side walls 20 extend substantially vertically from the openings 19 downwardly to the bottom walls 21. The walls 21 are spaced upwardly from the base wall 13.

Figure 1:
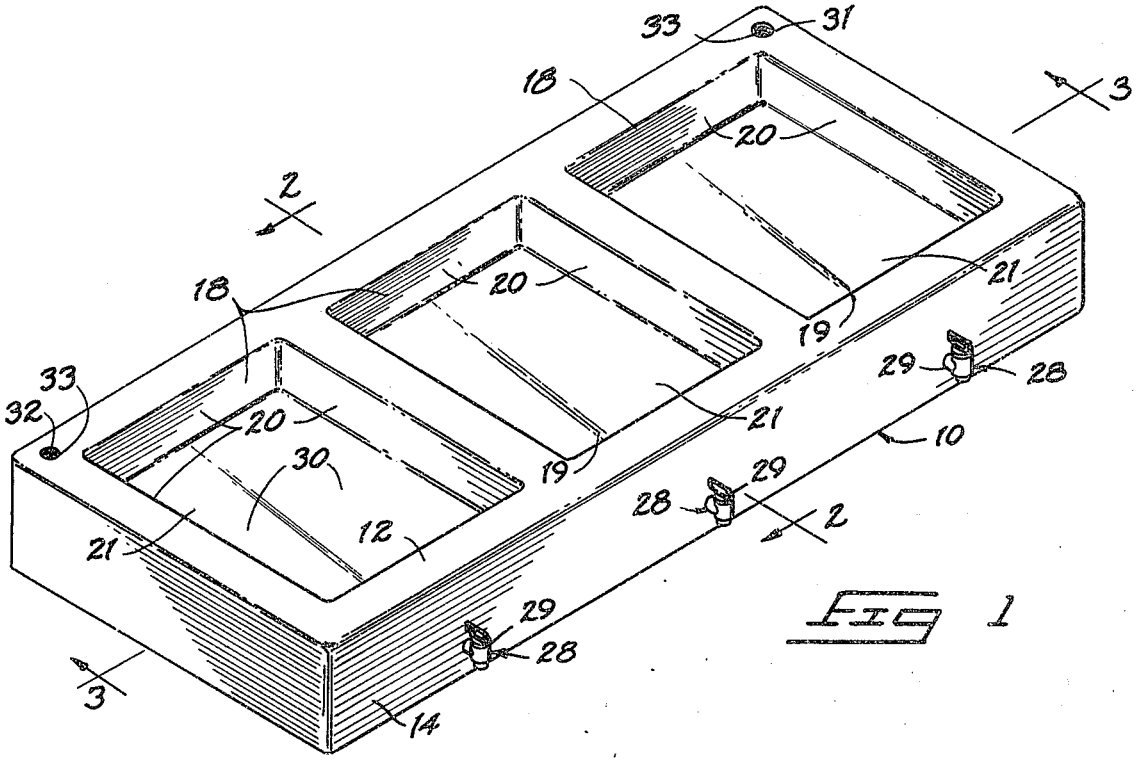
FIG. 1 is an isometric view of the present tank.

The trays 18 are substantially identical and are spaced apart along the length of the tank. It is noted that in FIGS. 1 and 3, that three individual trays are shown. However, it is contemplated that the number of trays may vary. Preferably the number should be between two and four.

It is important to note that the trays are separated from one another, each having its own set of peripheral walls 20. The trays are separated by open channels 24 of the water cavity 11. The channels 24 are equal in dimension between adjacent walls of the trays and body. Therefore, water within the cavity 11 will completely surround and embrace the peripheral walls 20 as well as the bottom walls 21 of each individual tray 18. The spaces between the outer walls of the tray indentations 18 and side walls 14 of the tank are equal so that the heat transfer from the water to the processing chemicals in the trays is uniform to maintain the chemicals in the various trays at the same temperature. Furthermore, the walls 14, 20 and 21 are of uniform thickness to further promote even transmittal of heat from the water to the processing chemicals in the trays. Experiments have shown that temperature differential between the chemicals in the various trays is less than 0.25° F.

It is intended that the cavity 11 include a volume or capacity that is somewhat greater than the capacity of the trays 18. By doing this, a "heat sink" provision is made whereby temperature of fluids within the indentations may be maintained over a relatively long period of time within a prescribed heat range.

A structural gusset 25 is provided between each tray 18 and a side wall of the unitary body. The gussets are substantially cylindrical in cross section and are formed integrally with the remainder of the unitary body. They provide structural rigidity to the body and define open drain passageways 26 for each tray.

The drain passageways 26 (FIG. 2) are provided for each of the trays 18. The drain passageways 26 extend from open ends **26*a* that open into the trays 18 through the gussets 25 to open ends 26*b* that are formed through one of the outer walls of the tank 10. Adjacent the open ends 26*b* are integral threaded portions 27 of the passageways. Threaded portions 27 threadably receive valve means 28 that allow selective drainage of the fluid from within the associated indentation. Valve means 28 preferably is comprised of standard petcocks 29** that are formed of corrosive resistant material such as synthetic resin.

Provision of the individual drain passageways and associated petcocks enables the dark room attendant to quickly and easily drain the trays of chemicals after use or when they become stale.

The petcocks 29 each include a manually operable valve stem **29*a* and downwardly open drain spouts 29*b*. A hollow threaded mounting stud 29*c* is also provided for threaded engagement within the complementary threaded portions of the drain passageways. The petcocks 29** are therefore easily mounted to the unitary body and may be as easily replaced if necessary.

To drain any tray, the attendant merely holds an appropriate receptacle under the drain spout **29*b*. He then simply turns the valve stem 29*a* to open the valve and allow the chemical from the associated tank to drain into the receptacle. The spouts 29b** may also receive or mount one end of a length of tubing (not shown) which could lead downwardly to a chemical receptacle.

The bottom walls 21 of the trays 18 include sloping sides 30 that slope toward the drain passageways 26 as best seen in FIGS. 2 and 3. This slope assures that the processing chemicals held within the indentations will drain completely through the passageways when the petcocks are open. There is therefore no need to lift the tank for drainage purposes.

It is noted that the gussets 25 are also formed integrally with the remainder of the tank construction. This unitary construction both aids structurally in providing rigidity to the tank structure and eliminates the danger of leakage evidenced in prior mechanically joined tank and tray structure.

Along the top wall 12 are provided a water inlet port 31 and a discharge port 32. The ports are formed integrally with the tank 10 and each include integral threaded portions 33. The ports 31, 32 and their threaded portions 33 are adapted to receive standard plumbing connectors such as hose or pipe fittings that will direct water into the cavity and drain the water therefrom.

It is again emphasized that the preferred tank structure is provided as a single unit formed preferably of a synthetic resin material. This is accomplished through a rotational molding process that is somewhat similar to that used for making hollow toy balls. A single female mold is provided. Removable core pieces are utilized to form the gussets and drain passageways 26. Plastic beads are placed in the mold. The mold is then heated and simultaneously rotated about two or more axes to cause the melting plastic to form by centrifugal force against the mold components. The mold is then allowed to cure and the plugs are removed to allow removal of the completed tank. The threaded portions 27 and 33 are formed integrally within the molded plastic to accept complementary threaded portions of the petcocks 29 and standard plumbing fittings. Therefore, after the molding process, the only step left prior to packing and shipping is the insertion of the petcocks 29.

It is easily understood from the above description that the present device may be constructed quickly and very economically, the result of which being that the average amateur photographer may easily afford the conveniences and desirable features of a multiple tray, water immersion processing tank. Additionally, the tank structure itself promotes an extremely even exchange of heat between water held within the cavity 11 and chemicals held within the indentations 18. The low temperature variations between indentations fall well below the ideal chemical temperature variation standards recommended for processing different photographic materials.

The drainage and above description is given by way of example to set forth a preferred form of the present invention. The following claims are intended to define the scope of my invention.

What I claim is:

1. A processing tank for developing light sensitive photographic materials, comprising:

a unitary body structure having an enclosed water cavity formed therein and defined by integral side, top and base walls;

said top wall having upwardly open processing chemical receiving indentations formed integrally therein, each indentation defining an individual photographic material processing tray to receive a respective photographic chemical therein, each tray having upright peripheral walls extending into the cavity to a bottom wall spaced upwardly from the base wall of the body;

the trays being spaced apart from one another, defining open channels about the periphery of the trays so that water within the cavity will surround each tray to maintain chemicals in the trays at the same temperature;

the unitary body having integral structural gussets extending through open channels between the trays and the side walls of the body;

the unitary body including an individual drain passageway for each tray extending outwardly through the upright peripheral walls of the trays, respective structural gussets and side walls of the body providing open fluid communication to individually drain the chemicals from the trays;

valve means in the drain passageways for selectively opening the drain passageways to permit draining of fluid from the associated indentations; and the unitary body having inlet and discharge ports opening into the water cavity through a wall thereof adapted to receive and direct water into the cavity and to discharge water therefrom.

2. The tank as defined by claim 1 wherein the bottom walls of the indentations slope toward the drain passageways.

3. The tank as defined by claim 1 wherein the peripheral walls and bottom walls of the indentations are uniform in thickness to allow uniform transfer of heat from the water surrounding the indentations to processing chemicals held within the indentations to maintain the chemicals at the same temperature.

4. The tank as defined by claim 1 wherein the inlet and discharge ports include integral threaded portions.

5. The tank as defined by claim 1 wherein the volume of the water cavity is greater than that of the trays.

6. The tank as defined by claim 1 wherein the drain passageways lead from the bottom walls of the trays outwardly to side walls of the body.

7. The tank as defined by claim 1 wherein the structural gussets, side, top and base walls of the body and the peripheral walls and bottom walls of the trays are of uniform thickness and formed of synthetic resin by a single rotary molding process.

8. The tank as defined by claim 1 wherein the inlet and discharge ports are formed through the top wall of the body.

9. The tank as defined by claim 1 wherein the passageways include integral threaded portions to threadably receive the valve means.

10. The tank as defined by claim 1 wherein three indentations are formed integrally with the top wall and wherein the three indentations define trays that are spaced apart equally from one another and from the side walls of the cavity.

* * * * *